US005832359A

United States Patent [19]

Acquaviva

[11] Patent Number: 5,832,359

[45] Date of Patent: Nov. 3, 1998

[54] APPARATUS AND METHOD FOR SENSING WATER FILM THICKNESS ON CONDITIONER ROLLS

[75] Inventor: Thomas Acquaviva, Penfield, N.Y.

[73] Assignee: Xerox Corporation, Stamford, Conn.

[21] Appl. No.: 939,512

[22] Filed: Sep. 29, 1997

[51] Int. Cl.[6] ..... G03G 15/20

[52] U.S. Cl. ..... 399/406; 399/325; 430/97

[58] Field of Search ..... 399/406, 397, 399/9, 341; 162/270, 271, 197; 430/97; 118/58; 250/559.27; 356/381

[56] References Cited

U.S. PATENT DOCUMENTS

| | | | |
|---|---|---|---|
| 4,254,732 | 3/1981 | Moser | 399/325 X |
| 4,652,110 | 3/1987 | Sato et al. | 399/406 |
| 5,185,644 | 2/1993 | Shimoyama et al. | 356/381 X |
| 5,264,899 | 11/1993 | Mandel | 399/341 |
| 5,434,029 | 7/1995 | Moser | 430/97 |

*Primary Examiner*—Arthur T. Grimley
*Assistant Examiner*—Sophia S. Chen
*Attorney, Agent, or Firm*—William A. Henry, II

[57] ABSTRACT

A device and method for measuring the thickness of liquid on an adjustable metering roll. The device comprising a transfer roll that mates with a back-up roll to form a nip through which a sheet passes for wetting a side of the sheet. An adjustable metering roll mates with the transfer roll and has a portion thereof positioned in a liquid filled sump for liquid to be added to an outside surface thereof. An optical sensor is positioned to detect the type of reflected light from the liquid on the outside surface of the metering roll and give off a Go/No Go signal when indicating contact between the metering roll and the transfer roll. The correct liquid thickness is obtained on the surface of the metering roll by further adjsutment of the metering roll.

21 Claims, 3 Drawing Sheets

APPARATUS AND METHOD FOR SENSING WATER FILM THICKNESS ON CONDITIONER ROLLS

BACKGROUND OF THE INVENTION

Cross reference is hereby made to copending and commonly assigned U.S. application Ser. No. 08/939,361, (D/97475) entitled Apparatus and Method for Automatically Adjusting Water Film Thickness of Conditioner Metering Rolls, by Thomas Acquaviva et al., and copending and commonly assigned U.S. application Ser. No. 08/808,412, filed Feb. 28, 1997, and entitled Paper Conditioner with Articulating Back-up/Transfer Rollers, by Thomas Acquaviva et al.

1. Field of the Invention

This invention relates generally to a substrate conditioning device for an electrophotographic printing machine and, more particularly, concerns a device to apply moisture to cut sheets or web fed material in a full color process printing machine.

2. Description of the Prior Art

In typical multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling.

Paper curl is defined as any deviation from it's flat state. In the xerographic process, fusing drives moisture out. When regaining moisture, paper experiences curl due to differential hygroexpansitivity between the paper and toner. The paper expands due to moisture reabsorption, but the toner does not expand, thus developing curl. Paper curl is one of the primary causes for paper handling problems in copying machines. Problems, such as, stubbing, image deletions and improper stacking resulting from copy sheet curl. These problems are more severe for color copies than black and white due to differences in their toner mass area, substrates, and fuser characteristics.

The following disclosures may be relevant to various aspects of the present invention:

U.S. Pat. No. 5,264,899

Patentee: Mandel

Issued: Nov. 23, 1993

U.S. Pat. No. 5,434,029

Inventor: Moser

Issue Date: Jul. 18, 1995

Portions of the foregoing disclosures may be briefly summarized as follows:

U.S. Pat. No. 5,264,899 describes a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the copy sheet as it is passed through the nip. The added moisture prevents edge wave formation.

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

There remains a need for a system for preventing curl caused by the loss of moisture from a copy sheet during the fixing step of electrostatographic reproduction or printing that is practical for use with electrostatographic machines and is non-subjective in indicating when the correct water thickness is obtained on metering rolls. Ordinarily, the film thickness on a transfer roll is set-up by adjusting the interference between a rubber metering roll and the transfer roll and observing the sheen on the metering roll. A commonly accepted procedure in the industry is to bring the metering roll in contact with the transfer roll. When they just make contact, the surface appearance on the black rubber metering roll changes from a gloss to a matte-like finish. Additional indentation of the rubber metering roll results in the correct water thickness being obtained. Currently, the only way to make this adjustment is by eye, i.e., observe the appearance of the metering roller. This procedure is not acceptable for customer machine set-up or in manufacturing. A more user friendly methodology is required.

SUMMARY OF THE INVENTION

Accordingly, there is provided a device for adding controlled amounts of moisture to a transfer roll. The device comprising a transfer roll that mates with a back-up roll to form a nip through which a sheet passes for wetting one side of the sheet. A metering roll mates with the transfer roll and has a portion thereof positioned in a liquid filled sump for liquid to be added to an outside surface thereof. An optical sensor is positioned to detect the type of reflected light from the liquid on the outside surface of the metering roll and gives off a Go/No Go signal when the two rolls are in contact. The correct liquid thickness is obtained on the surface of the metering roll by an additional amount of turns of screws connected to the metering roll.

In accordance with another aspect of the invention there is provided a system for fixing a toner image to a copy sheet in an electrophotographic system so as to avoid the formation of copy sheet curl. The system comprising first and second fusing rollers defining a nip therebetween, at least one of said fusing rollers being heated, wherein the fusing rollers serve to fix a toner image on a copy sheet through the application of heat and pressure to the copy sheet; a conditioning system for receiving a copy sheet from said fusing rollers, comprising; a transfer roll and a back-up roll positioned with respect to each other that they form a nip therebetween when a sheet is present therein; a metering roll that mates with said transfer roll to form a nip therebetween, said metering roll having a portion thereof positioned within a liquid filled sump for liquid to be added to an outside surface thereof; and an optical sensor that detects the type of reflected light from the liquid on the outside surface of the metering roll and gives off a Go/No Go signal indicating contact between said transfer and metering rolls. The desired thickness of liquid on the surface of the metering roll is then obtained by additional movement of said metering roll with respect to said transfer roll.

In accordance with yet another aspect of the invention there is provided a method for sensing liquid film thickness on a conditioner metering roll. The method comprising the steps of: providing a reservoir of liquid; positioning a black rubber metering roll with respect to the reservoir such that rotation of the metering roll places liquid from the reservoir onto a longitudinal outside surface of the metering roll; positioning a transfer roll having a longitudinal outside surface with respect to the metering roll such that a nip is formed between the rolls; positioning at least one optical sensor adjacent the longitudinal outside surface of the metering roll; and sensing the thickness of liquid on the longitudinal surface of the metering roll with the optical sensor.

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
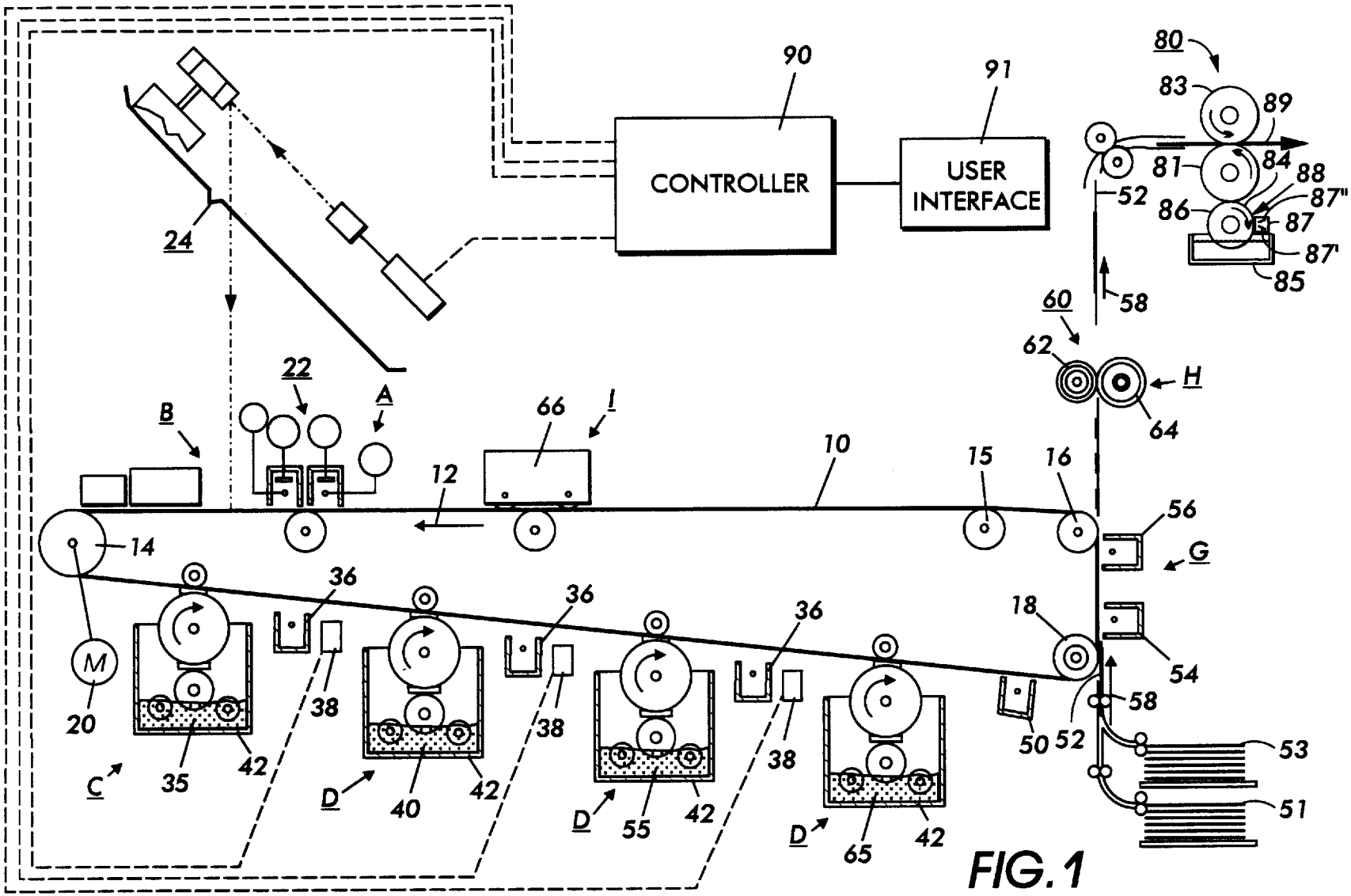
FIG. 1 is a schematic elevational view of a full color image-on-image single pass electrophotographic printing machine utilizing the sheet conditioning device described herein.

Turning now in general to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, idler roller 15, tension roller 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, which is manipulated by user interface 91, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C which contains black toner 35, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles 35 (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager for a third suitable color toner 55, such as, magenta and for a fourth imager and suitable color toner 65, such as, cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets in trays 51 and 53. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to sheet moisture replacement system 80 and then to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
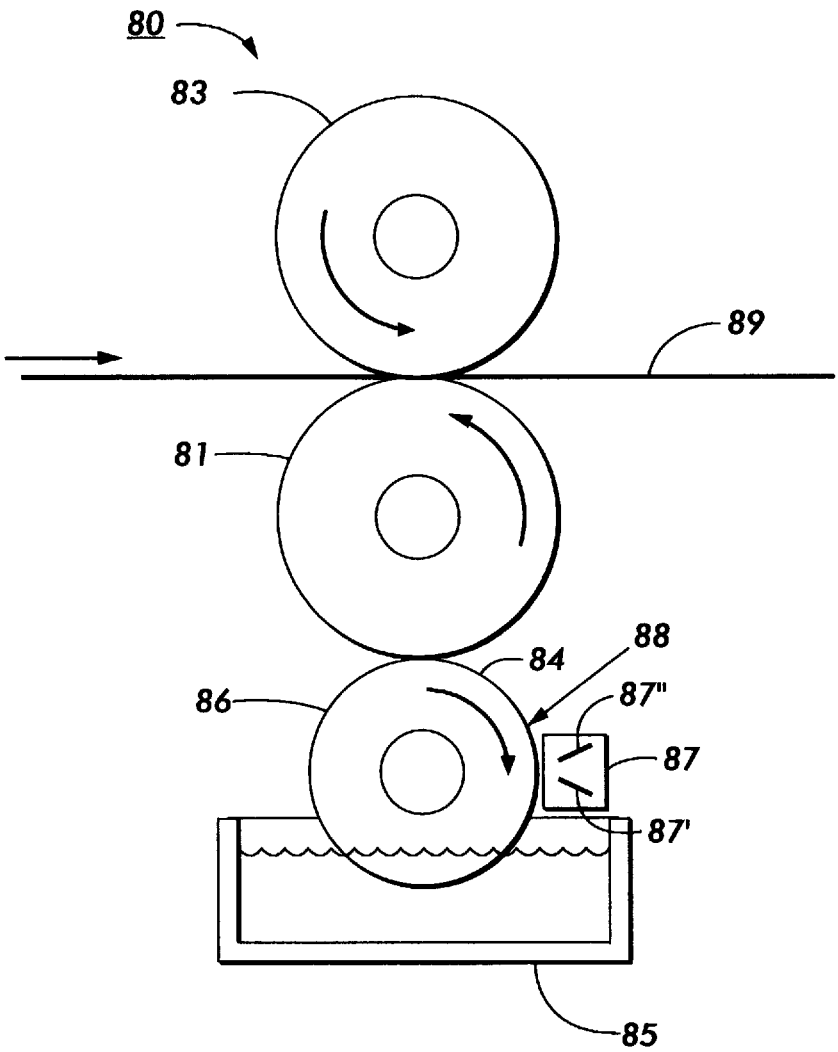
FIG. 2 is a side view of a sheet conditioning apparatus including a device for sensing liquid film thickness on a metering roll.

As shown in FIG. 2, a sheet conditioning apparatus, generally referred to as reference numeral 80, has counter clockwise rotatable transfer roll 81 and counter clockwise rotatable back-up roll 83 positioned to be contacted by a sheet and form a nip therebetween while a sheet is present. Transfer roll 81 is preferably hydrophilic and chrome plated while metering roll 84 is preferably coated with black rubber. Transfer roll 81 and back-up roll 83 are fixed while metering roll 84 that is in nip forming contact with transfer roll 81 is adjustable by conventional means, for example, an adjustment screw mechanism can be used in which the transfer roll bearings are secured in a frame member. Metering roll bearings are mounted in a slotted portion of the same frame member. The metering roll-bearings are free to move toward the transfer roller causing an indentation. An adjustment screw pushes directly on the metering roll bearings to cause the metering roll shaft to move toward the transfer roll. The screw is turned so many degrees and the bearing will move forward a given distance depending on the screw thread. Metering roll 84 rotates clockwise and has a portion thereof situated within an open part of fluid pan 85. Conventional motors (not shown) are connected to the transfer, back-up and metering rolls and are adapted to drive the transfer and back-up rolls in the opposite direction to sheet travel through paper path 89 to thereby apply fluid to a sheet. The wetting agent, in this case water, is distributed to metering roll 84 from pan 85.

Figure 3:
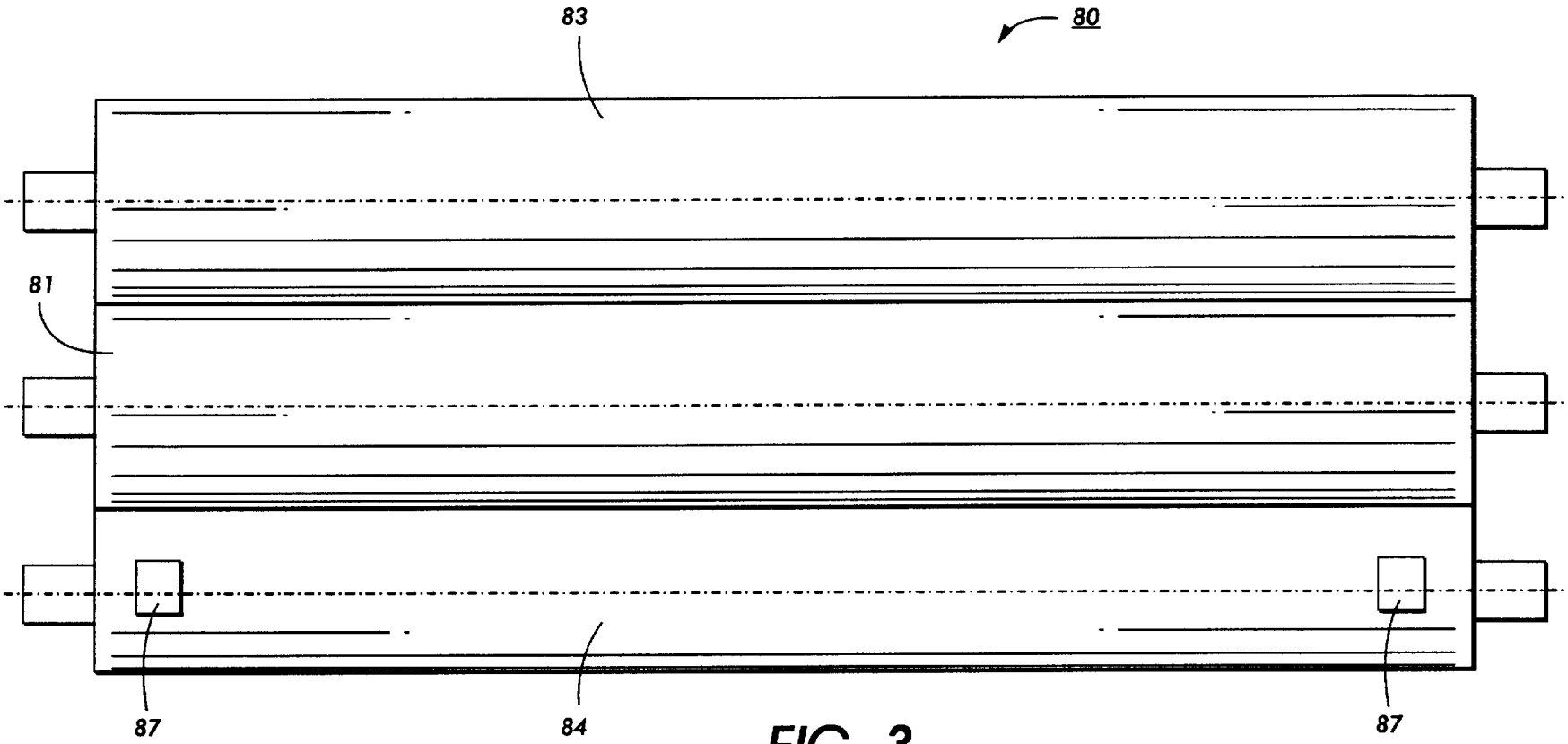
FIG. 3 is a partial end view of the sheet conditioning apparatus of FIG. 2.

In accordance with the present invention, a device 87 which is connected to controller 90, is used to indicate the correct or desired water film thickness on metering roll 84. Device 87 is preferably an optical sensor that includes an input 87' and an output 87". Preferably, two optical sensors 87 are used to indicate water film thickness of metering roll 84 as shown in FIG. 3. The sensors are positioned with respect to the outer surface of metering roll 84 such that the incident angle of light reflects off the metering roll surface. Sensor 87 is conventional and consists of a pulsed infrared light emitting diode 87' and a phototransistor 87".

In use, a light beam from 87' is directed at the surface of the rotating metering roll 84 on the metered side 88. The unmetered side of metering roll 84 is at 86. When the water film is thick, i.e., the metering roll is not touching the transfer roll, the surface of the metering roll 84 is glossy and the light beam is reflected into output 87". When the transfer and metering rolls touch, and the water film is thin, the surface of the metering roll takes on a matte-like appearance, and the light beam scatters after leaving the roll surface. Hence, a minute amount of light would arrive at sensor output 87". As shown in FIG. 3, preferably, two identical sensors 87 are used with one on each side of metering roll 84. An operator (service technician, customer, or manufacturing set-up person) would adjust the interference between the transfer and metering rolls an receive and electrical signal from the sensor. For example, the transfer and metering rolls would start apart and a "low" sensor signal would indicate a glossy surface. The rolls would be brought together with conventional adjustment screws until a "high" signal is obtained indicating a thin film. An optimum water thickness setting can be obtained by turning the adjustment screw an additional number of turns, depending on an adjsutment screw thread, past this setting.

In recapitulation, a conditioner adds a small amount of water to sheets in order to control sheet curl. The conditioner includes a device that indicates when the correct water thickness is obtained on a metering roll. The device uses an optical sensor to detect the type of reflected light from the water surface on the metering roll. With this sensor, the operator of the machine does not have to rely on a subjective set-up procedure, but instead relies on a Go/No Go signal from the sensor to know when the desired water thickness on the outer surface of the metering roll had been reached.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A device for measuring thickness of liquid on a metering roll, comprising:

a transfer roll that mates with a back-up roll to form a nip when a sheet passes therethrough for wetting a non-imaged side of the sheet;

a metering roll that forms a nip with said transfer roll;

a liquid filled sump, said metering roll including a portion thereof positioned within said liquid filled sump for adding liquid to an outer surface thereof;

an optical sensor positioned to detect the type of reflected light from the liquid on said outer surface of said metering roll, said optical sensor being configured to give off a Go/No Go signal when a desired liquid thickness is obtained on said outer surface of the metering roll.

2. The device of claim 1, wherein said metering roll is adjustable.

3. The device of claim 2, wherein said optical sensor is positioned on a metered side of said metering roll.

4. The device of claim 3, wherein said transfer roll rotates in a counter clockwise direction.

5. The device of claim 4, wherein said back-up roll rotates in a counter clockwise direction.

6. The device of claim 5, wherein said metering roll rotates in a clockwise direction.

7. The device of claim 6, wherein said transfer roll is chrome plated.

8. The device of claim 7, wherein said metering roll is coated with black rubber.

9. The device of claim 8, wherein said transfer roll is hydrophilic.

10. The device of claim 1, wherein said transfer roll rotates in a direction opposite to a sheet feeding direction.

11. The device of claim 1, wherein said transfer roll rotates in a direction opposite to a sheet feeding direction.

12. The device of claim 1, wherein said transfer roll is hydrophilic.

13. A system for fixing a toner image to a copy sheet in an electrophotographic system so as to avoid the formation of copy sheet curl, comprising:

first and second fusing rollers defining a nip therebetween, at least one of said fusing rollers being heated, wherein the fusing rollers serve to fix a toner image on a copy sheet through the application of heat and pressure to the copy sheet; and a conditioning system for receiving a copy sheet from said fusing rollers, comprising; a transfer roll and a back-up roll positioned with respect to each other to form a nip therebetween when a sheet is present therein; a metering roll that mates with said transfer roll to form a nip therebetween, said metering roll having a portion thereof positioned within a liquid filled sump for liquid to be added to an outside surface thereof; and an optical sensor that detects the type of reflected light from the liquid on said outside surface of said metering roll and gives off a Go/No Go signal when the liquid has or has not reached a desired thickness on said outside surface of said metering roll.

14. The system of claim 13, wherein said metering roll is adjustable.

15. The system of claim 14, wherein metering roll has an unmetered side and a metered side, and wherein said optical sensor is positioned on said metered side of said metering roll.

16. The system of claim 15, wherein said transfer roll rotates in a counter clockwise direction.

17. The system of claim 16, wherein said back-up roll rotates in a counter clockwise direction.

18. The system of claim 17, wherein said metering roll rotates in a clockwise direction.

19. The system of claim 18, wherein said transfer roll is chrome plated.

20. The system of claim 19, wherein said metering roll is rubber coated.

21. The system of claim 20, wherein said rubber coating is black.

* * * * *